US007549914B2

(12) United States Patent
Ladjias

(10) Patent No.: US 7,549,914 B2
(45) Date of Patent: Jun. 23, 2009

(54) POLISHING SYSTEM

(75) Inventor: Andreas C. Ladjias, Kinnelon, NJ (US)

(73) Assignee: Diamex International Corporation

( * ) Notice: Subject to any disclaimer, the term of this patent is extended or adjusted under 35 U.S.C. 154(b) by 365 days.

(21) Appl. No.: 11/238,174

(22) Filed: Sep. 28, 2005

(65) Prior Publication Data

US 2007/0072526 A1 Mar. 29, 2007

(51) Int. Cl.
*B24D 11/00* (2006.01)

(52) U.S. Cl. ..... 451/533; 451/550

(58) Field of Classification Search ..... 451/526, 451/530, 532, 533, 536, 550; 51/297, 298
See application file for complete search history.

(56) References Cited

U.S. PATENT DOCUMENTS

| | | | | |
|---|---|---|---|---|
| 4,728,552 | A | 3/1988 | Jensen, Jr. | |
| 4,841,680 | A | 6/1989 | Hoffstein et al. | |
| 4,927,432 | A | 5/1990 | Budinger et al. | |
| 4,954,141 | A | 9/1990 | Takiyama et al. | |
| 5,020,283 | A | 6/1991 | Tuttle | |
| 5,197,999 | A | 3/1993 | Thomas | |
| 5,212,910 | A | 5/1993 | Breivogel et al. | |
| 5,297,364 | A | 3/1994 | Tuttle | |
| 5,394,655 | A | 3/1995 | Allen et al. | |
| 5,489,233 | A | 2/1996 | Cook et al. | |
| 5,533,923 | A | 7/1996 | Shamouilian et al. | |
| 5,562,530 | A | 10/1996 | Runnels et al. | |
| 6,126,532 | A | 10/2000 | Sevilla et al. | |
| 6,139,402 | A | 10/2000 | Moore | |
| 6,331,139 | B2 | 12/2001 | Walker et al. | |
| 6,344,414 | B1 | 2/2002 | Davis et al. | |
| 6,561,891 | B2 * | 5/2003 | Eppert et al. | 451/530 |
| 6,592,438 | B2 * | 7/2003 | Tolles et al. | 451/287 |
| 6,592,443 | B1 | 7/2003 | Kramer et al. | |
| 6,652,764 | B1 | 11/2003 | Blalock | |
| 6,685,537 | B1 | 2/2004 | Fruitman et al. | |
| 6,699,104 | B1 * | 3/2004 | Baker et al. | 451/28 |
| 7,267,601 | B2 * | 9/2007 | Horie et al. | 451/28 |
| 7,354,334 | B1 * | 4/2008 | Birang et al. | 451/6 |
| 2001/0031612 | A1 * | 10/2001 | Scott et al. | 451/65 |
| 2003/0181135 | A1 * | 9/2003 | Liu | 451/6 |
| 2007/0054601 | A1 * | 3/2007 | Bottema et al. | 451/41 |

FOREIGN PATENT DOCUMENTS

| | | |
|---|---|---|
| WO | WO 9615887 A1 | 5/1996 |

* cited by examiner

*Primary Examiner*—Timothy V Eley
(74) *Attorney, Agent, or Firm*—Dority & Manning, P.A.

(57) ABSTRACT

The disclosed invention is directed to an improved polishing system that can attain improved values in surface topography, and in particular, improved surface planarity of a polished substrate. The system can prevent the formation of deformities at the polishing surface of the system. The system includes openings that are adjacent certain layers of the system. In particular, the system includes openings, such as channels, for example, formed adjacent to an adhesive layer in the system. Thus, as gases, e.g., air, are released from the semi-solid adhesive during operation of the system, the gases can be trapped, dissipated, or vented by the openings rather than form pressure points in the system that can lead to surface deformations on the polishing surface.

19 Claims, 4 Drawing Sheets

POLISHING SYSTEM

BACKGROUND OF THE INVENTION

Industry has for many years utilized techniques for cutting and polishing materials such as glass, metals, semiconductors, stones, crystals, and the like. In general, the processes include one or more polishing steps in which a polishing pad of a suitable material is applied against the surface to be treated with motion and pressure. A mechanical and/or chemical polishing formulation, usually in slurry form, can be located between the pad and the surface to be treated. When pressure is applied, the polishing formulation carried in the slurry can cut, grind, and/or polish the surface, finishing the surface to the desired topography.

Over time, it has become necessary to develop methods for cutting and polishing substrate surfaces to ever decreasing levels of surface variation from planar. For example, maximum surface variations from planar on the order of angstroms are now desirable when forming products such as semi-conductor wafers and computer hard discs. As such, improvements to chemical mechanical polishing processes have been developed in an attempt to meet the desired standards. For example, slurry delivery and distribution across the face of the polishing pad has been improved through the development of flow channels, holes, or pressure variations across the pad itself such as described in U.S. Pat. Nos. 5,489,233 to Cook, et al., 5,533,923 to Shamoiullian, et al., and 5,562,530, to Runnels, et al., all of which are incorporated herein by reference. Other methods developed to improve polishing techniques have evolved around improvements to the pad material itself, such as those methods described in U.S. Pat. No. 6,126,532 to Sevilla, et al., also incorporated herein by reference that describes an improved open-celled, porous polishing pad substrate having sintered particles of synthetic resin.

Unfortunately, in spite of such improvements, problems can still arise at any point in the polishing process, preventing the formation of a surface having the desired planar surface. For instance, any of the polishing pads used in a multi-stage polishing process, from the initial lapping process to the final chemical mechanical polishing process, can develop uneven surface abnormalities, which can transfer to the substrate being polished.

For example, FIG. 1 illustrates a typical prior art polishing pad system generally 10 including an uppermost polishing pad 12, carrying a layer of a polishing slurry 25. The polishing pad system 10 also includes an adhesive laminate 15 that includes a first adhesive layer 14, a second adhesive layer 16, and an impermeable film layer 18 between the two. The polishing pad system 10 can be attached to a platen 20 via the adhesive laminate 15, as shown. As can be seen in FIG. 2, during the polishing process, gas micro-bubbles 8 can form in the adhesive layers 14, 16. During the course of operating the system, the micro-bubbles 8 can agglomerate and form larger bubbles 13. The larger bubbles 13 can exert pressure on their surroundings, and in particular on the impermeable layer 18 adjacent the adhesive layer 16. This pressure can in turn cause a deformity 22*a* to develop in the impermeable layer, as can be seen in FIG. 2. This deformity 22*a* can translate upward through the other layers of the system, and can cause a similar deformity 22*b* to develop on the polishing surface of the polishing pad 12. Once a polishing pad becomes uneven at its surface, as illustrated in FIG. 2, its useful life is over as a surface deformity 22*b* can be transferred from the pad to the surface of the substrate to be polished, and the substrate itself can be rendered useless for its intended purpose or even destroyed.

A need currently exists for an improved polishing system. In particular, what is needed in the art is a polishing system that can prevent surface deformities from developing on the polishing surface of the system.

SUMMARY OF THE INVENTION

In one embodiment, the present invention is directed to a polishing system comprising an uppermost polishing pad. In general, the polishing surface of the uppermost polishing pad can define the 'top' of the system. The system can also include a layer below the uppermost polishing pad that is formed of an impermeable material and a layer of adhesive material beneath this layer, for example, a layer of temporary adhesive for attaching the system to a platen. In accordance with the invention, the system also defines one or more openings defined by a surface of the adhesive material or defined by a surface immediately adjacent to the adhesive for trapping, dissipating, or venting gas that can be released from the adhesive during utilization of the system.

The openings can be defined by any surface, as long as they are immediately adjacent to the adhesive layer that is beneath the impermeable material. For example, the openings can be defined by the lower surface of the layer formed of an impermeable material, or optionally can be defined by either the upper or the lower surface of the adhesive.

In addition, the openings can have any suitable geometry for either trapping or venting gases released from the adhesive. For example, the openings can comprise channels that extend to an edge of the system. In one embodiment, the openings can take the form of isolated recesses for trapping gas released from the adhesive.

In one particular embodiment, the layer formed of an impermeable material can be adjacent and beneath a porous material. In this particular embodiment, the openings can include holes that pass through the layer formed of an impermeable material, such that any gases released from the adhesive can be vented or dissipated into the porous material.

In one embodiment, the layer formed of an impermeable material can be a single layer of a multi-layer adhesive laminate. In particular, the adhesive laminate can include an upper adhesive layer, a lower adhesive layer, and the layer formed of an impermeable material between the two adhesive layers.

In another embodiment, the layer formed of an impermeable material can be the bottom surface of the uppermost polishing pad. For example, in those embodiments wherein the polishing pad has been sintered to form an impermeable layer on the bottom thereof, the bottom "skin" of the polishing pad can be the layer formed of an impermeable material.

The disclosed system can generally be directed to any standard polishing system as is known in the art that includes an adhesive material beneath a layer formed of an impermeable material. For example, the system can be a multi-pad system that includes a backing polishing pad beneath the uppermost polishing pad. In this particular embodiment, the layer formed of an impermeable material can be located between the two pads and/or beneath the backing polishing pad. In one embodiment, the layer of impermeable material can be a surface of the backing polishing pad.

The impermeable material can be any material as is generally known in the art. For example, in certain embodiments the impermeable material can be a polyester material, such as Mylar®, for example, or a polycarbonate material.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
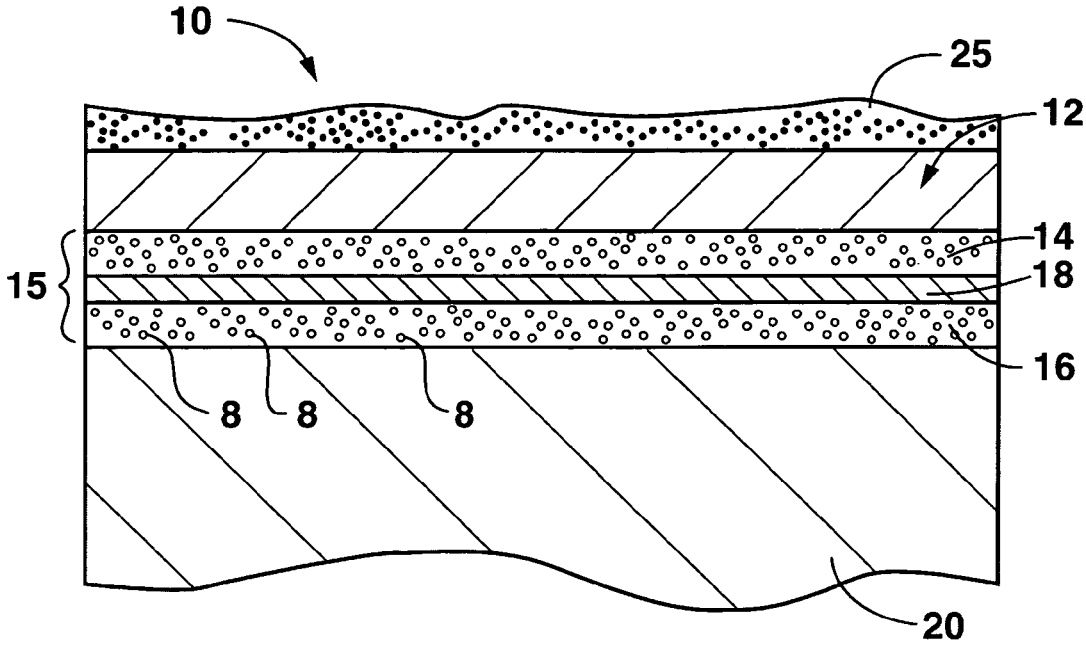
Prior Art FIG. 1
FIG. 1 illustrates a prior art polishing pad system including a polishing pad which is adhesively secured to a platen with an adhesive laminate including a first adhesive layer, an impermeable film layer, and a second adhesive layer.

Repeat use of reference characters in the present specification and drawings is intended to represent same or analogous features of elements of the invention. Other objects, features and aspects of the present invention are disclosed in or are obvious from the following detailed description.

DETAILED DESCRIPTION OF THE INVENTION

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to an improved polishing system for polishing the surface of a substrate. More specifically, the invention is directed to a multi-layer polishing pad system that includes openings formed into a layer of the system. The openings of the disclosed invention can trap, dissipate, or vent gases released from adhesive layers of the system and thus prevent the development of deformities on the polishing surface of the polishing pad. As such, the polishing pad systems of the present invention can have a longer useful life than polishing pad systems utilized in the past. In addition, the disclosed polishing pad systems can provide polished surfaces with less variation from the desired surface planarity and fewer surface deformities as compared to surfaces polished with polishing pad systems known in the past.

The polishing pad systems of the present invention can be formed into any desired overall configuration. In particular, though the ensuing description is generally directed to polishing pad systems designed specifically for planar surfaces, it should be understood that the polishing pad systems of the present invention can be sized and shaped so as to grind and/or polish planar surfaces as well as three-dimensional surfaces. As such, the polishing pad systems of the present invention can take various and sundry forms including, for example, a polishing surface having a predetermined two- or three-dimensional shape, endless turned bands, discrete particles secured to a rotary support member, or any other desired form. In addition, the present system is applicable to any polishing system that employs a polishing pad for cutting, grinding, and/or polishing a substrate surface. For example, the present system can be employed in purely mechanical polishing processes as well as in chemical mechanical processes.

Figure 5:
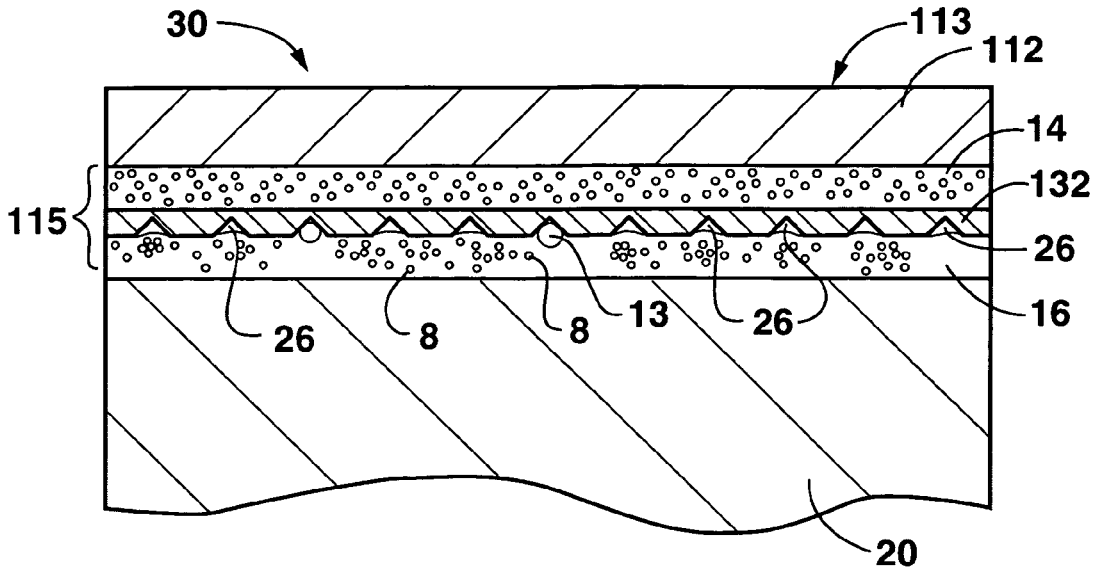
FIG. 5 illustrates one embodiment of a polishing pad system of the present invention.

Referring to FIG. 5, one embodiment of a polishing pad system generally 30 of the present invention is illustrated. As can be seen, the polishing pad system 30 includes an uppermost polishing pad 112 and at least one layer 132 formed of a gas impermeable material.

The uppermost polishing pad 112 of the presently disclosed polishing system can be any suitable polishing pad as is generally known in the art. In general, the choice of polishing pad material can depend upon at least in part on the characteristics of the substrate to be polished by the system as well and the level of planarity desired for the substrate following the polishing process. For example, the uppermost polishing pad 112 of the presently disclosed system can include a polishing pad manufactured from either soft or rigid pad materials.

The uppermost polishing pad 112 can be, in one embodiment, a polishing pad formed of a unitary bat of fibers, for example a polymer-impregnated fabric. One particular embodiment of an uppermost polishing pad of this type can include a polymer, such as a polyurethane resin, impregnated into a polyester non-woven fabric. Such pads are commonly manufactured by preparing a continuous roll or web of a nonwoven fabric; impregnating the fabric with the polymer, e.g., polyurethane; curing the polymer; and cutting, slicing and buffing the pad to the desired thickness and lateral dimensions.

Other uppermost polishing pads 112 suitable for the presently disclosed system include polishing pads formed of microporous films. Polishing pads of this type generally consist of microporous urethane films coated onto a base material that is often an impregnated fabric as described above. The porous films can be composed of a series of vertically oriented closed end cylindrical pores.

Other types of uppermost polishing pads 112 suitable for the system of the present invention can include pads formed of cellular polymer foams. Polishing pads of this type can be closed cell polymer foams having a bulk porosity that is randomly and uniformly distributed in all three dimensions. The volume porosity of closed cell polymer foams is typically discontinuous, thereby inhibiting bulk slurry transport. In those embodiments wherein slurry transport is desired, the pads can be artificially textured with channels, grooves or perforations to improve lateral slurry transport during polishing.

Other representative examples of uppermost polishing pads suitable for the polishing pad system of the present invention are described in International Publication No. W096/15887, U.S. Pat. Nos. 4,728,552, 4,841,680, 4,927,432, 4,954,141, 5,020,283, 5,197,999, 5,212,910, 5,297,364, 5,394,655, 5,489,233, and 6,126,532, all of which are incorporated herein by reference.

The polishing pad system 30 illustrated in FIG. 5 also includes an adhesive laminate 115, which includes a first adhesive layer 14, a second adhesive layer 16 and a layer 132 formed of a gas impermeable material between the two adhesive layers. The adhesive laminate 115 can be utilized in one embodiment to adhere the polishing pad system 30 to a platen 20 during the useful life of the uppermost polishing pad 112.

The upper adhesive layer 14 nearest the uppermost polishing pad can generally be any adhesive suitable to the process requirements. For example, the adhesive layer 14 can be formed of a pressure-sensitive adhesive, a hot melt adhesive, a spray adhesive, a liquid adhesive, a light-cure adhesive, a urethane, a rubber-based adhesive, an epoxy, a cyanoacrylate, or any other suitable adhesive as is generally known in the art. In one particular embodiment, the adhesive layer 14 may be a blown adhesive. In one embodiment, the adhesive layer 14 can include a permanent adhesive, though this is not a requirement of the present invention. For purposes of this disclosure, a permanent adhesive is herein defined as an adhesive that can hold the polishing pad system components together indefinitely.

The layer 132 formed of an impermeable material can be formed of any impermeable material as is suitable for use in an adhesive laminate as herein described. For example, the adhesive laminate 15 can include layer 132 formed of a polymeric film, for example a polypropylene or a polyester film. In one particular embodiment, the layer 132 can be formed of a Mylar® film located between two adhesive layers 14, 16. The layer 132 can serve not only as a carrier for the adhesives, but can also prevent slurry from accessing the platen 20, which could interfere with the adhesion between the polishing pad system 30 and the platen 20 during the useful life of the polishing pad system.

The lower adhesive layer 16, which can adhere the polishing pad system 30 to a platen 20, can in one embodiment be formed of a temporary adhesive though this is not a requirement of the present invention. In addition, the adhesive of layer 16 can be the same as or different from the adhesive of adhesive layer 14. For example, the adhesive layer 16 can be a temporary pressure sensitive adhesive. In general, the adhesive layer 16 can include an adhesive that will not exhibit excessive deformation under process conditions. In other words, the adhesive layer 16 can be formed of a material that will not flow excessively during use of the polishing system.

During the polishing process, the platen 20, to which the polishing pad system 30 is adhered, can spin. Over time, gases within the semi-solid adhesive materials can begin to migrate within the adhesive layers 14, 16 due to the combination of dynamic forces of the polishing process and the heat generated by the process. As the gases migrate within the layers 14, 16, they can begin to agglomerate, causing the formation microbubbles 8 and bubbles 13 within the adhesive layers 14, 16.

Figure 2:
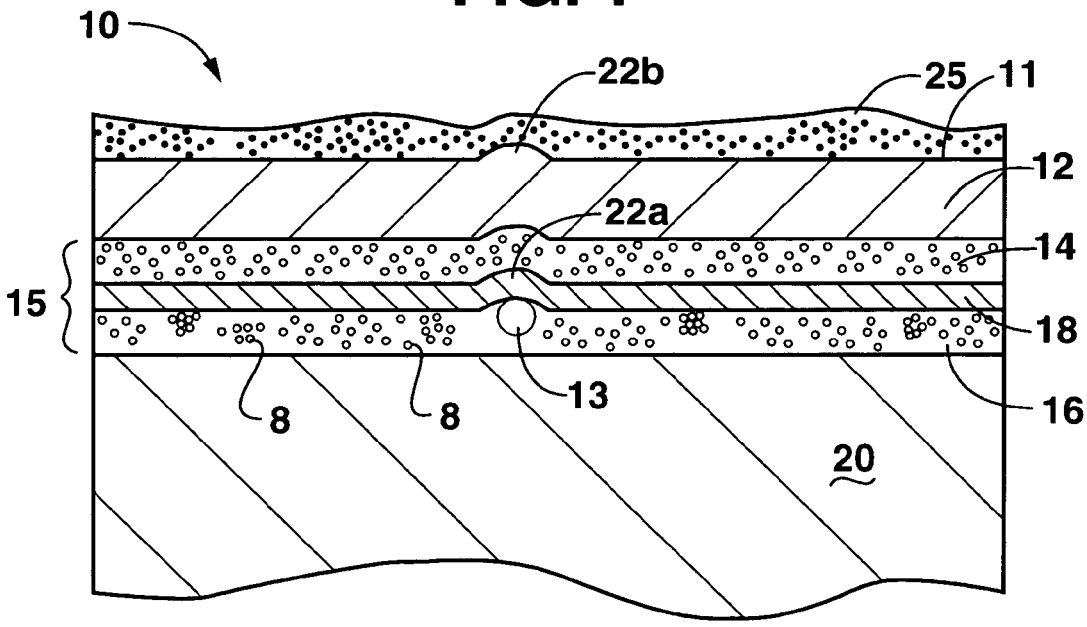
Prior Art FIG. 2
FIG. 2 illustrates the polishing pad system of FIG. 1, in which microbubbles in the second adhesive have agglomerated to form a pressure point.

As discussed above in regard to Prior Art FIGS. 1 and 2, when an adhesive is located beneath a layer formed of an impermeable material, the formation of bubbles 13 in the adhesive layer 14 during operation of the system 10 can lead to the formation of a pressure point at impermeable layer 18. Moreover, the pressure point can cause a deformation 22*a* in the impermeable layer 18, as shown in Prior Art FIG. 2. This physical deformation can then translate upward through the polishing pad to the surface of the pad. At the very least, a physical deformation 22*b* at the top surface of the pad can interfere with the flow of the slurry across the pad/substrate interface, which can in turn prevent the process from obtaining the desired surface planarity or smoothness. Often, however, even more deleterious effects are seen, from flaws created in the substrate surface due to the deformation 22*b* to actual breakage of the substrate.

In accordance with the present invention, a system has been designed which can prevent the formation of this deformation in the system. More specifically, and referring again to FIG. 5, the present system provides openings 26 adjacent to adhesive layer 16 located beneath an impermeable material 132 during operation of the system. The openings 26 adjacent the adhesive layer 16 can trap, dissipate, or vent gases released from the semi-solid adhesive 16 and thus can prevent deformation in the layer 132 located above the adhesive layer 16 as well as in the polishing surface 113 of the polishing pad system. As openings 26 can generally be at a lower relative pressure as compared to the semi-solid adhesive material, bubbles 13 and microbubbles 8 that can develop in the semi-solid adhesive layer 16 can tend to migrate toward the openings 26.

Figure 6:
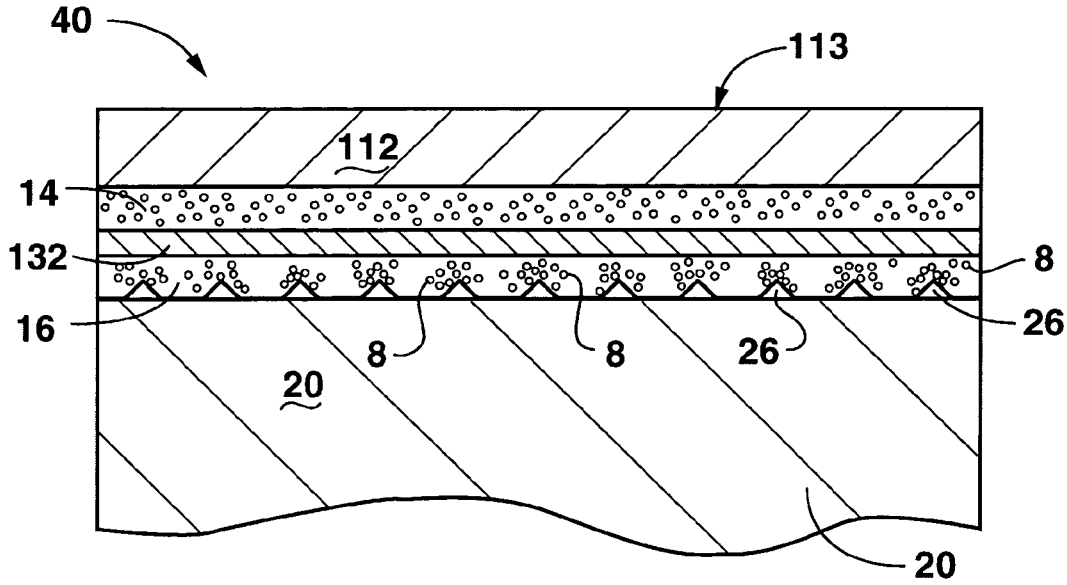
FIG. 6 illustrates another embodiment of a polishing pad system of the present invention.

Another possible embodiment of the polishing pad system of the present invention is illustrated in FIG. 6. As can be seen, in this embodiment the openings 26 of the system 40 can be channels formed into the lower surface of the adhesive layer 16. For example, a combing or indentation forming device may be used to form the openings 26 on a surface of the adhesive. In this particular embodiment, openings 26 have been formed on the lower surface of the adhesive layer 16.

The openings 26 can be of any size, shape and orientation so as to prevent the formation of a pressure point at the layer 132 formed of an impermeable material that is located between the adhesive layer 16 and the polishing surface 113 of the polishing pad system. In general, the openings 26 can be relatively small, for example an individual opening 26 can be less than about 0.25 inches in cross-sectional width. In some embodiments, an individual opening 26 can be less than about 0.02 inches in width. In one embodiment, a single individual opening 26 can be between about 5 μm and about 500 μm in width.

The individual openings 26 need not be evenly spaced with regard to one another in the disclosed systems. For example, as the gas bubbles 13 will tend to move toward the center of the spinning platen 20 during a polishing process, certain embodiments of the present invention can include a greater number of openings 26 or a greater volume of space defined by the openings closer to the center of the platen 20 and fewer openings 26 or less available volume in openings at the outer edges of the platen 20. Moreover, the total concentration of openings 26 can vary, depending upon the size of the individual openings, the process conditions, as well as the characteristics of the adhesive material utilized.

In general, openings 26 can be of a depth so as to provide the desired air space between the adhesive layer 16 and the adjacent layer (layer 132 in FIG. 5) during polishing operations, without interfering with the usefulness of the layer into which the openings 26 are formed. For example, according to one embodiment, the depth of the openings 26 can be roughly equivalent to about half the thickness of the layer 132. This is not a requirement of the present invention, however. For instance, in other embodiments, described in greater detail below, the openings 26 can pass completely through the layer into which they are formed. For example, in one embodiment, the openings 26 can be formed as holes through the layer 132.

Figure 3:
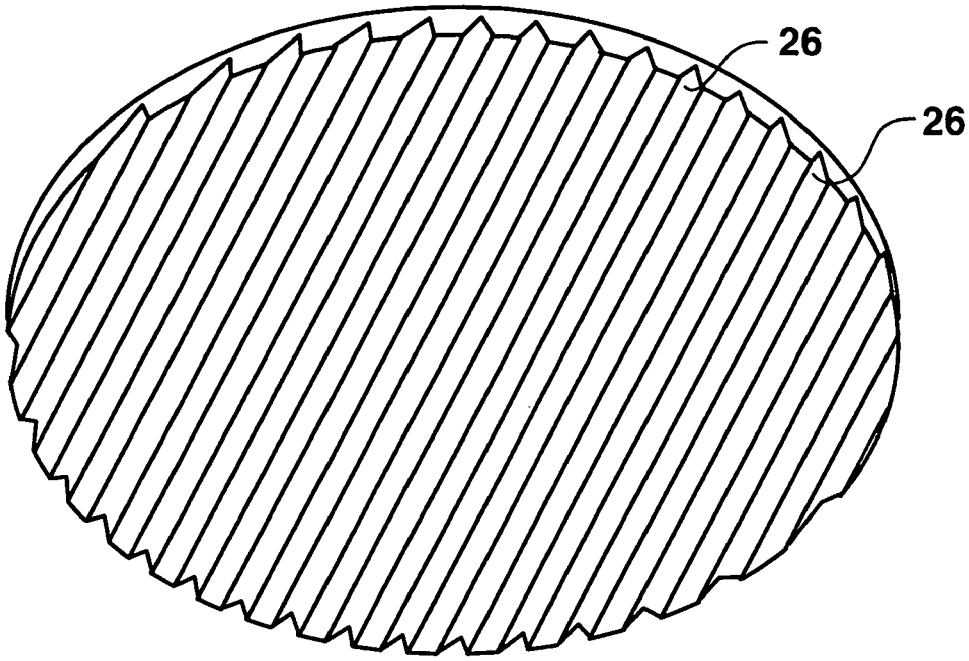
FIG. 3 illustrates one embodiment of openings of the present invention formed as channels on the surface of a layer of a polishing pad system.

One embodiment of the openings 26 is illustrated in FIG. 3. According to this particular embodiment, the openings 26 can be a series of channels formed into the surface of a layer, for instance, the lower surface of layer 132 or either surface of adhesive layer 16. Individual openings 26 can have a width and depth as described above and a length stretching to at least one edge of the layer 132. According to the embodiment of FIG. 5, the openings 26 can be formed into the surface of layer 132 that will be adjacent the adhesive layer 16 during utilization of the polishing pad system 30. Accordingly, gas bubbles 13 that can form in the adhesive layer 16 can agglomerate and migrate and can either become trapped in the openings 26, as seen in FIG. 5, or alternatively the gas can be vented out of the polishing pad system 30 at an edge of the system 30.

Figure 4:
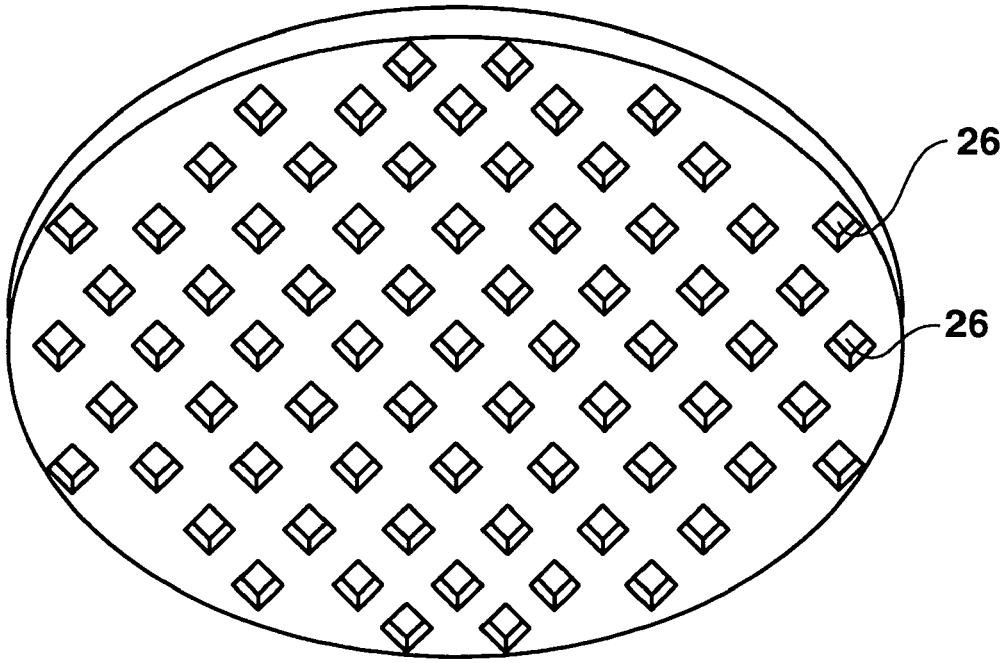
FIG. 4 illustrates another embodiment of openings of the present invention formed as recesses in the surface of a layer of a polishing pad system.

Another possible embodiment of the openings 26 of the present invention is illustrated in FIG. 4. According to this particular embodiment, the openings 26 can be in the form of isolated recesses in a layer, for example, layer 132 or the adhesive layer 16. According to one particular embodiment, the openings 26 do not pass completely through the layer into which they are formed. As such, according to this particular embodiment, the openings 26 can function as gas 'reservoirs', wherein the agglomerated gas bubbles 13 can be captured and trapped within the openings 26. As the initial pressure within the areas 26 can generally be lower than that of the adjacent adhesive material, the trapping of the bubbles 13 in the openings 26 can prevent the formation of a pressure point against the impermeable material, which can lead to surface deformation, as discussed above.

It should be understood that the cross-sectional shape of the openings 26 is not critical to the present invention. For example, though illustrated in FIGS. 3, 5, and 6 as V-shaped channels and in FIG. 4 as square indentations, the openings could also have an arcuate, an irregular, or any other shape.

Figure 8:
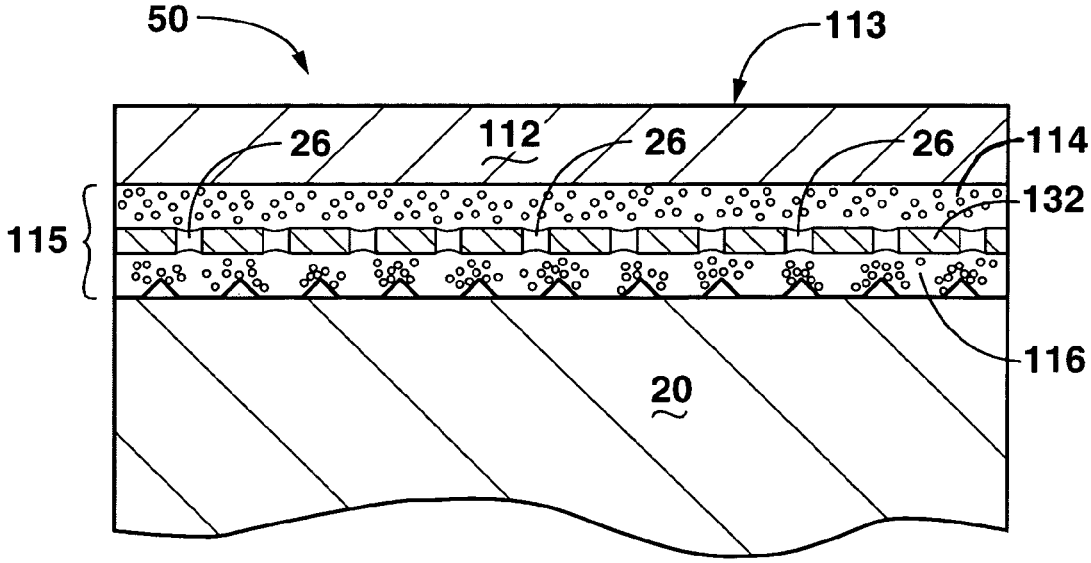
FIG. 8 illustrates another embodiment of a polishing pad system of the present invention.

Another embodiment of the present invention is illustrated in FIG. 8. According to this embodiment, openings 26 can pass completely through the layer 132 of polishing system 50. This particular embodiment may be utilized, for example, when the layer 114 immediately above layer 132 is of a construction that can disperse, trap, or vent gas released from adhesive layer 116. For example, in the embodiment illustrated in FIG. 8, adhesive laminate 115 can include an upper adhesive layer 114 that can be a porous blown adhesive layer 114 located between the uppermost polishing pad 112 and the layer 132 formed of impermeable material. As blown adhesives can have a naturally occurring porosity, according to this embodiment, openings 26 can pass completely through layer 132 and allow gas from bubbles 13 to be vented into the porous layer 114 via openings 26. As such, the gas can be dissipated throughout the porous layer 114 and the formation of pressure points that could cause a deformation of the surface 113 of the uppermost polishing pad 112 can be prevented.

Porous layer 114 need not be an adhesive layer, however. For instance, in other embodiments, porous layer 114 can be a fibrous bat of a material, such as a polishing pad, for example, that can be directly attached to the layer of impermeable material 132. For example, in one embodiment of the invention, illustrated in FIG. 7, uppermost polishing pad 142 of system 60 can be a porous material and can include a surface layer 133 that is essentially impermeable as the lower surface of the uppermost polishing pad 142. For example, in some embodiments, the uppermost polishing pad 142 can have an impermeable "skin" layer across the bottom surface of the pad 142 that can be formed when the pad is sintered in finishing operations. In other embodiments, the uppermost polishing pad 142 can be formed directly on an impermeable material, e.g., a polyester or polycarbonate base material, with no adhesive layer between the layer 133 of impermeable material and the porous uppermost polishing pad 142. According to one such embodiment, the openings 26 can be holes through the layer 133 formed of an impermeable material. Optionally, openings 26 in such an embodiment can be similar to any others previously described herein, i.e., the openings 26 need not pass completely through the layer 133 formed of an impermeable material.

Figure 7:
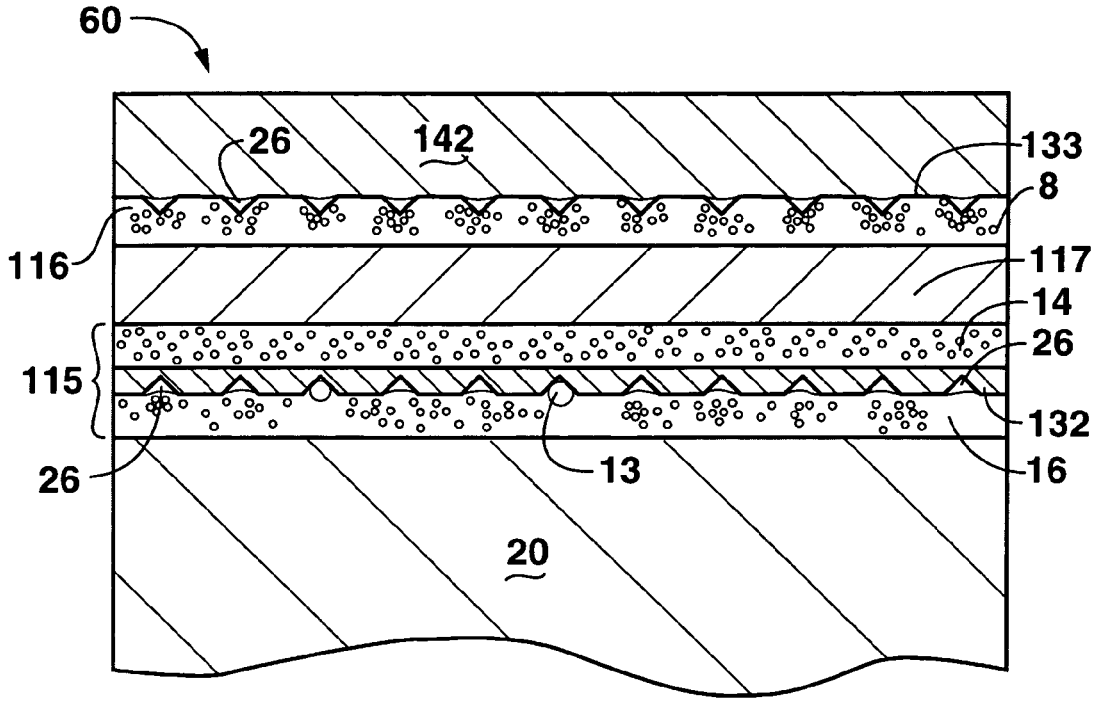
FIG. 7 illustrates another embodiment of a polishing pad system of the present invention.

While the previous discussion has dealt primarily with polishing pad systems that include only a single uppermost polishing pad. It should be understood that the disclosed invention is suitable for application to any polishing pad system that includes an adhesive beneath an impermeable material. For example, many polishing pad systems used in chemical mechanical polishing operations utilize a two pad system 60, as illustrated in FIG. 7 that can include an uppermost polishing pad 142 and a backing pad 117. For instance, the backing pad 117 can be attached to a platen 20 via an adhesive laminate 115. According to this embodiment, the adhesive laminate 115 can include openings 26 adjacent to the adhesive layer 16 that are, in this particular embodiment, formed into the layer 132 of impermeable material. In addition, the system 60 can include a second layer formed of an impermeable material 133 adjacent to adhesive layer 116 and defining openings 26 as discussed above.

Any layer of the system that can be formed of an impermeable material can be treated to avoid pressure points as herein described. For example, a backing pad can include an impermeable polycarbonate layer and can have an adhesive layer beneath it. As such, according to the present invention, openings can be formed adjacent to the adhesive to trap, vent, or dissipate gases released from the adhesive layer.

In general, the disclosed system can include openings adjacent any adhesive layer that is itself located beneath a layer formed of an impermeable material during system operation.

It will be appreciated that the foregoing examples, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention that is defined in the following claims and all equivalents thereto. Further, it is recognized that many embodiments may be conceived that do not achieve all of the advantages of some embodiments, yet the absence of a particular advantage shall not be construed to necessarily mean that such an embodiment is outside the scope of the present invention.

What is claimed is:

1. A polishing system comprising:

an uppermost polishing pad comprising a polishing surface defining the top of the polishing system;

an adhesive laminate below the uppermost polishing pad, the adhesive laminate including a layer formed of an impermeable polymeric film, the adhesive laminate further including an adhesive material beneath the layer formed of an impermeable polymeric film; and wherein one or more openings are defined by the lower surface of the impermeable polymeric film adjacent to the adhesive material for trapping, dissipating, or venting gas released from the adhesive.

2. The system of claim 1, wherein the one or more openings comprise channels that extend to an edge of the system.

3. The system of claim 1, wherein the one or more openings are isolated recesses for trapping gas released from the adhesive.

4. The system of claim 1, wherein the adhesive laminate is adjacent and beneath a porous material.

5. The system of claim 1, the system further comprising a backing polishing pad beneath the uppermost polishing pad.

6. The system of claim 5, wherein the adhesive laminate is between the uppermost polishing pad and the backing polishing pad.

7. The system of claim 5, wherein the adhesive laminate is beneath the backing polishing pad.

8. The system of claim 1, wherein the impermeable polymeric film is a polyester material.

9. The system of claim 1, wherein the impermeable polymeric film is a polycarbonate material.

10. The system of claim 1, wherein the adhesive material comprises a temporary adhesive.

11. A polishing pad system comprising:

an uppermost polishing pad comprising a polishing surface defining the top of the polishing system;

an adhesive laminate beneath the uppermost polishing pad, the adhesive laminate comprising:

an upper adhesive layer, a lower adhesive layer, and a polymeric film formed of an impermeable material between the upper and lower adhesive layer; wherein the polishing pad system defines multiple openings in the lower surface of the polymeric film, the multiple openings being immediately adjacent to the lower adhesive layer.

12. The system of claim 11, wherein the multiple openings comprise channels that extend to an edge of the system.

13. The system of claim 11, wherein the multiple openings are isolated recesses for trapping gas from the adhesive.

14. The system of claim 11, wherein the upper adhesive layer is porous.

15. The system of claim 14, wherein the one or more openings comprise holes through the polymeric film.

16. The system of claim 11, the system further comprising a backing polishing pad.

17. The system of claim 16, wherein the adhesive laminate is between the uppermost polishing pad and the backing polishing pad.

18. The system of claim 16, wherein the adhesive laminate is beneath the backing polishing pad.

19. The system of claim 11, wherein the polymeric film is a polyester material.

* * * * *